United States Patent [19]

de poorter

[11] 4,345,525

[45] Aug. 24, 1982

[54] FURNITURE STRUCTURE

[76] Inventor: Christian de poorter, Via Canonica, 91, 20154 Milano, Italy

[21] Appl. No.: 43,037

[22] Filed: May 29, 1979

[30] Foreign Application Priority Data

May 26, 1978 [IT] Japan ..... 21959B/78

[51] Int. Cl.[3] ..... A47B 9/14; A47B 47/00

[52] U.S. Cl. ..... 108/107; 108/111; 108/149; 211/134; 211/187

[58] Field of Search ..... 108/107, 12, 109, 111, 108/149, 110; 211/134, 147, 187

[56] References Cited

U.S. PATENT DOCUMENTS

| | | | |
|---|---|---|---|
| 1,705,129 | 3/1929 | McGoogan | 211/195 |
| 1,976,031 | 10/1934 | Lowenberg | 108/12 |
| 2,767,950 | 10/1956 | Bellon et al. | 248/243 |
| 2,915,196 | 12/1959 | Pira | 108/109 |
| 2,954,125 | 9/1960 | Husted | 108/149 X |
| 3,143,980 | 8/1964 | Sperring | 108/111 X |
| 3,184,068 | 5/1965 | Wende | 108/107 X |
| 3,295,695 | 1/1967 | Carmstrom | 211/187 |
| 3,353,507 | 11/1967 | Squires | 108/107 |
| 3,785,301 | 1/1974 | Lundquist | 211/134 X |

FOREIGN PATENT DOCUMENTS

| | | | |
|---|---|---|---|
| 2334393 | 1/1975 | Fed. Rep. of Germany | 108/109 |
| 1021510 | 12/1952 | France | 108/107 |
| 1705129 | 7/1968 | France . | |
| 2074449 | 9/1971 | France . | |
| 2178420 | 10/1973 | France . | |

*Primary Examiner*—James T. McCall

*Attorney, Agent, or Firm*—Stevens, Davis, Miller & Mosher

[57] ABSTRACT

Furniture structure comprising vertical side frames and horizontal pieces, hooking means in the form of a simple pin, in a fitting point between the horizontal piece and the side frame, as well as anchorage means in the form of rigid rods, situated at about 45° in respect to horizontal pieces and to side frames, and fitted therein.

4 Claims, 5 Drawing Figures

FURNITURE STRUCTURE

BACKGROUND OF THE INVENTION

The subject of this invention is furniture structures which can be mainly used as shelves, but also as another furniture piece such as a wardrobe, a table, a chair or other.

Furniture structures composed of shelves are at present largely known, in different constructive forms. They are based on the general conception of fitting in, assembling and/or hooking the shelf pieces onto vertical rods or side frames.

In order to have these structures composable according to the users' wishes, the shelf pieces are fitted in onto the vertical rods or frames by means of easy connections, which must act both as a support of the shelf pieces and link and stiffen the structure.

Often these connections—operating at the fitting point of the shelf piece to the vertical rod or side frame—are not sufficient to create a stable stiffening of the structure, since they permit the user easy assemblage and disassemblage.

SUMMARY OF THE INVENTION

The present invention has the purpose of proposing a different structure, while at the same time offering an easy assemblage, without the need of special devices, and nevertheless accomplishing a solid fitting between frames and shelf pieces.

The structure of the present invention achieves this result by connecting the shelf pieces to the frame by means of simple pin hooking in the fitting point, and rigid rods anchorage set at 45° between the shelf and the rods and fitted into them.

More specifically, each of these anchoring rods consists of a straight iron rod, having the two ends in a short U shape. These ends are fitted, by a minimal clearance, in holes situated in the thickness of the shelf pieces and the frames, parallel to the surface of these latters and spaced from the pertaining fitting point.

BRIEF DESCRIPTION OF THE DRAWINGS

Other features and advantages of the furniture structure of the present invention are clearly shown in the following specification of a preferred accomplishing form, illustrated by the enclosed drawings, in which.

DESCRIPTION OF THE PREFERRED EMBODIMENT

Figure 1:
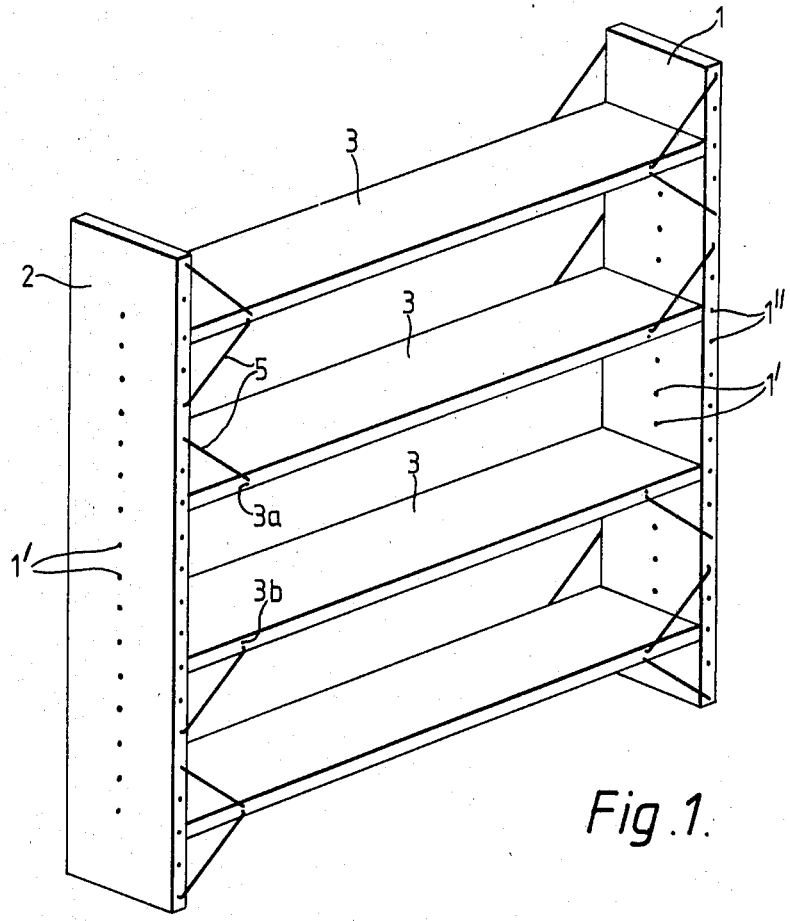
FIG. 1 is a schematic perspective view of shelves, which can be obtained by the structure according to the present invention.

An example of furniture using the structure according to the present invention is represented by the shelves illustrated in FIG. 1. It consists, as usual, of side frames 1, 2 where shelf-pieces 3 are fitted in, which can be placed at different distances.

Figure 2:
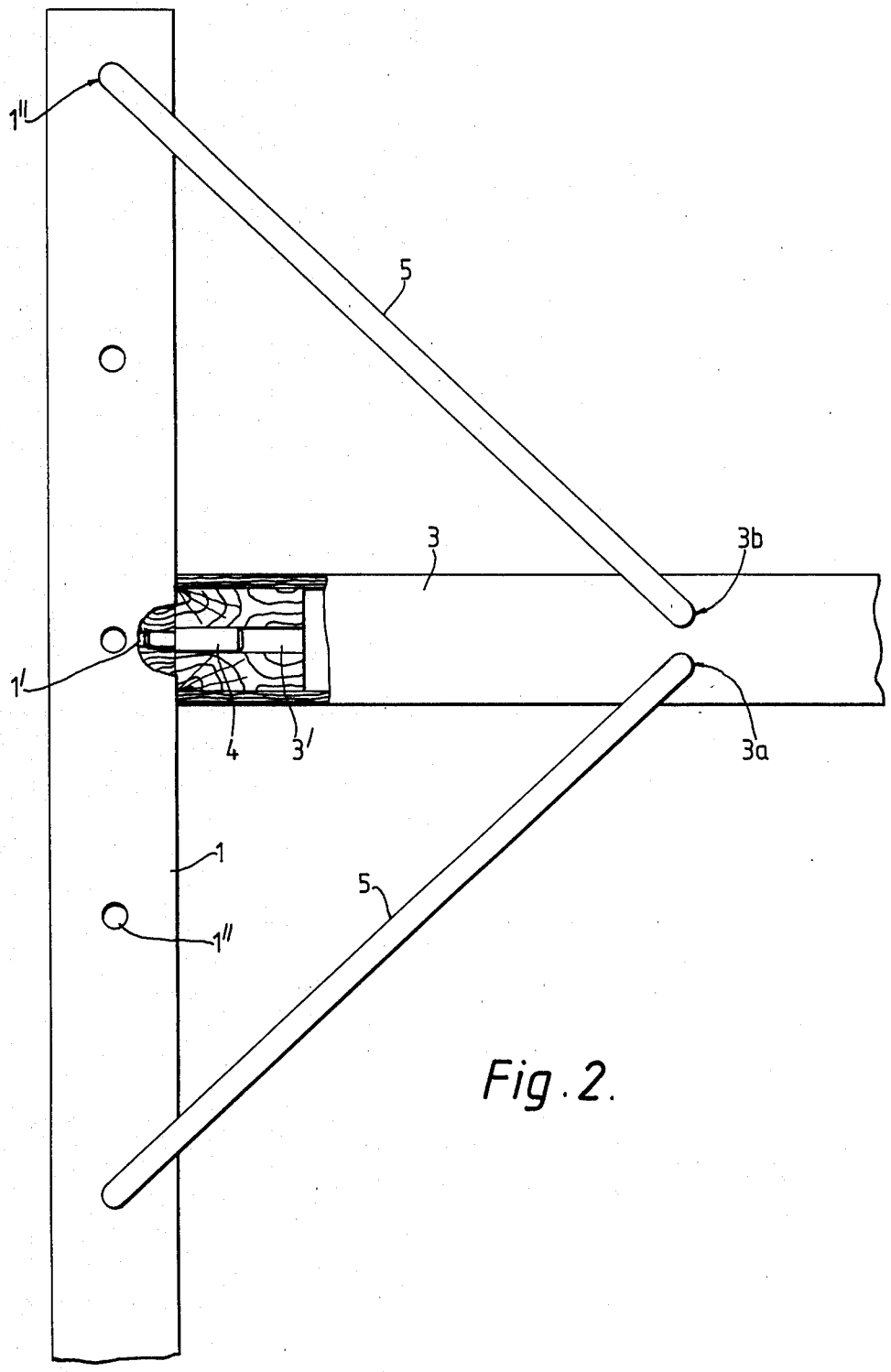
FIG. 2 is a front elevation view, partial section, of the connecting point of the shelf piece to the frame.

This positioning is obtained—as better shown in FIG. 2—by means of:

hooking means, formed by a simple pin 4, fitted on one side in the hole 3' of the shelf piece 3, and on the other side in the hole 1' of the frame 1. Practically this pin has only the purpose to give the correct positioning of the shelf piece;

anchorage means, consisting of at least one rigid rod 5, placed at about 45° between the shelf piece and the frame, and fitted in these elements. The fitting points of rod 5 being far from the fitting point of pin 4, this giving a correct reciprocal anchorage of these elements and a considerable stiffening of the structure, avoiding—as it becomes obvious—any oscillation possibility of the shelf piece in respect to the frame.

Figure 5:
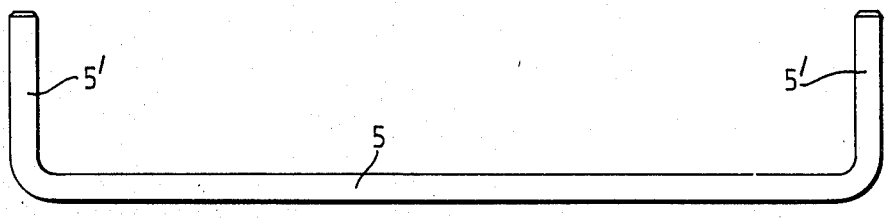
FIG. 5 is a plane view of an U shaped iron rod element.

As it is shown in FIG. 5, the rigid rod 5 preferably consists of a straight iron rod, square bended to form an U element.

Figure 4:
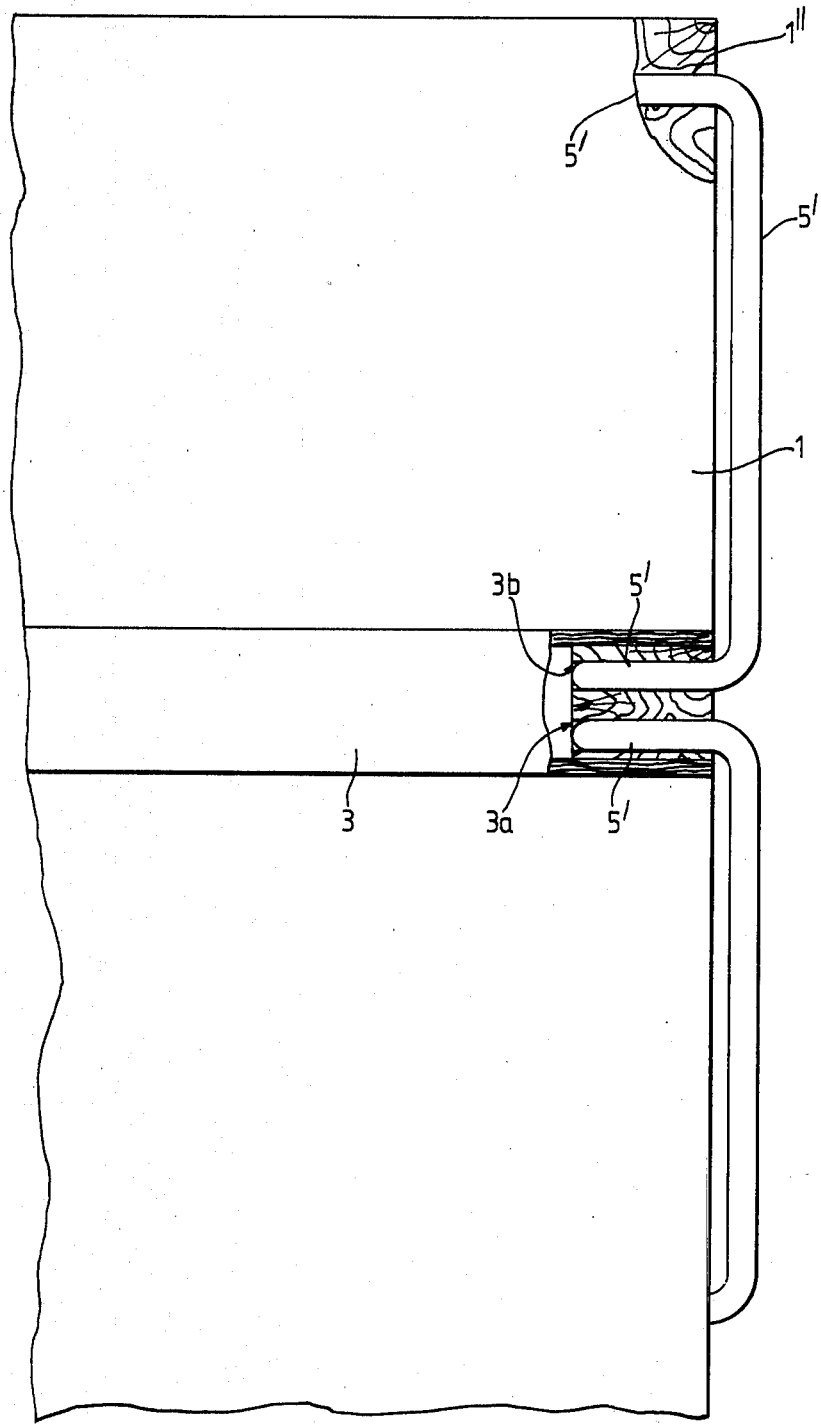
FIG. 4 is a side view, partial section, of the same connection point of FIG. 2.

As it is clearly shown in FIG. 4, the fitting of rod 5 on shelf-pieces and side frame takes place by hooking, with minimal clearance, the bended ends 5' of the same rod 5 in the holes **3*a* and 3*b* of the shelf piece as well as the holes 1''** of the side frame.

FIG. 1 shows that any shelf piece presents—at two relatively spaced positions of its opposite edges—a couple of holes **3*a* and 3*b*. The side frames have a set of holes 1'', regularly spaced on their length. Holes 3*a* and 3*b*, as well as holes 1''**, are made in the thickness of the shelf pieces and of the side frames and have a parallel axis with the surface of these elements, as is shown in the drawings.

The lay-out of FIG. 1 shows the attachment of shelf pieces to side frames by means of couples of rods 5 in correspondence with their two ends—as is the case for the top and bottom shelf pieces of shelves illustrated in FIG. 1. These couples of rods are placed on the front and on the rear sides of the shelves.

It is not necessary to employ a couple of rods 5 in correspondence with every fitting point for getting the requested stiffening action in the structure. Therefore some of them—particularly the two intermediate ones of FIG. 1—can be supported by a single rod per each edge.

In such a case it is even possible to eliminate the hooking pin 4, which makes considerably easier the possible movement by length of one of the intermediate shelf pieces. The employment of one or more rods can be decided by the user in accordance with the desired degree of stiffening of the structure, and in relation with the loads the shelf pieces have to support, or with aesthetic requirements.

Figure 3:
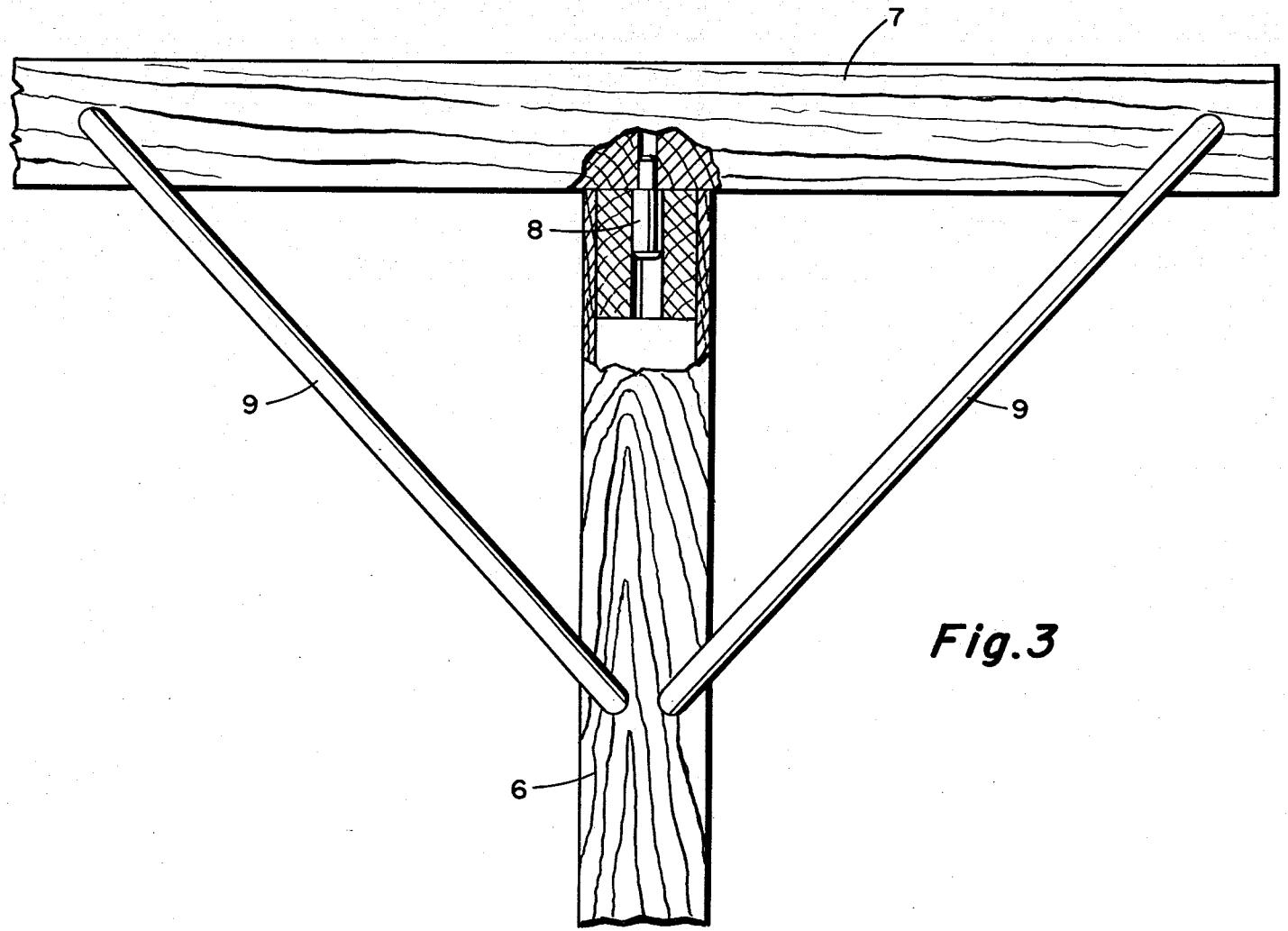
FIG. 3 is a view similar to FIG. 2 but relating to the connection point of a table-leg to the table top.

FIG. 3 shows the possibility of using the structure of the present invention not only for shelves, but also for example for a table. In this case, the leg 6 of the table is first of all hooked under the top 7 of the table by means of a pin 8 similar to pin 4 of FIG. 2.

Furthermore, the necessary stiffening between the leg and the top of the table is obtained by means of a couple of tension rods similar to rods 5 of FIG. 2.

No further precise information seem to be necessary for illustrating the fitting of tie rods 9 on the leg and on the top of the table, since the fitting is identical to the one described in reference to FIG. 4.

As already specified, the structure of the present invention can be employed, besides for shelves or table, for other kinds of furniture too, such as wardrobes, benches, chairs, structures for display or others.

I claim:

1. A furniture structure comprising at least two vertical framing pieces, at least one horizontal framing piece, each said vertical framing piece defining two opposed sides with spaced holes in each side and a third side perpendicular to said two sides, at least one hole in said third side perpendicular to said spaced holes, said horizontal framing piece defining two opposed sides with spaced holes in each side and at least two holes in said horizontal framing piece each aligned with one hole in said third side of a vertical framing piece when assembled, a pin fitting within said hole of said third side of said vertical framing piece and the aligned hole of said horizontal framing piece and rigid rods positioned at about 45° with respect to the vertical and horizontal framing pieces and fitting within holes in the sides of said vertical and horizontal framing pieces.

2. The structure of claim 1 wherein said rigid rods have ends which are squarely bent to form a substantial U-shape.

3. The structure of claim 2 wherein the holes in the sides of the vertical and horizontal framing pieces are parallel to the principle surfaces of said pieces.

4. The structure of claim 2 or claim 3 in the form of a table.

* * * * *